US005855105A

United States Patent [19]

Ferris

[11] Patent Number: 5,855,105

[45] Date of Patent: Jan. 5, 1999

[54] CARTONER WITH DIRECT DROPPING OF POUCHES INTO CARTONS

[75] Inventor: Judd M. Ferris, Elgin, Ill.

[73] Assignee: Cloud Corporation, Des Plaines, Ill.

[21] Appl. No.: 885,695

[22] Filed: Jun. 30, 1997

[51] Int. Cl.[6] ..... B65B 5/10

[52] U.S. Cl. ..... 53/475; 53/244; 53/245; 53/534; 53/535; 53/540

[58] Field of Search ..... 53/245, 244, 447, 53/448, 475, 251, 534, 535, 540, 542

[56] References Cited

U.S. PATENT DOCUMENTS

| | | | |
|---|---|---|---|
| 1,926,060 | 9/1933 | Peters | 53/244 |
| 3,102,374 | 9/1963 | Lloyd et al. | 53/244 X |
| 3,486,296 | 12/1969 | Hechenleitner | 53/244 X |
| 3,815,321 | 6/1974 | Hartman | 53/244 X |
| 4,144,694 | 3/1979 | Stapp et al. | 53/245 X |
| 4,524,566 | 6/1985 | Hauers et al. | 53/245 X |
| 4,537,008 | 8/1985 | Benz | 53/245 X |
| 4,608,808 | 9/1986 | Ryan et al. | 53/535 X |
| 4,633,651 | 1/1987 | Edmunds | 53/559 X |
| 4,633,653 | 1/1987 | Roberts et al. | 53/535 X |
| 4,662,152 | 5/1987 | Simelunas et al. | 53/251 X |
| 4,750,315 | 6/1988 | Wadell | 53/251 X |
| 4,807,741 | 2/1989 | Simelnnas et al. | 53/253 X |
| 4,955,929 | 9/1990 | Klapp | 53/244 |
| 5,012,628 | 5/1991 | Van Oord | 53/535 X |
| 5,235,796 | 8/1993 | Campbell et al. | 53/535 |

*Primary Examiner*—Daniel B. Moon
*Attorney, Agent, or Firm*—Dorn, McEachran, Jambor & Keating

[57] ABSTRACT

A pouch making machine has a pin conveyor which receives finished pouches from a knife and transfers them to a cartoner where they are stacked in a carton in a continuous motion. The cartoner indexes the carton after entry of each pouch, or group of pouches, so that an empty portion of the carton is aligned with the pin conveyor's discharge path to receive the next pouches released from the conveyor. When a carton is full the cartoner executes a long move to discharge the filled carton and position a succeeding carton for receipt of the next pouches. The cartons are held with the bottom wall angled or tilted from both the horizontal and vertical so that during filling pouches in the carton are neither standing on edge nor piled in a vertical stack.

7 Claims, 4 Drawing Sheets

10
6
114
116
118A
118B
120A
120B
122A
122B
124
126
128A
128B
129
130A
130B
132
134
136
138
140
142
144
146A
146B
148
152
154
156
158
160
162
164
165
166
168
170
172
174
176
178
180
182

CARTONER WITH DIRECT DROPPING OF POUCHES INTO CARTONS

BACKGROUND OF THE INVENTION

This invention relates to a machine and method for continuously forming a series of filled pouches from a continuous web of flexible material and packing the pouches in a carton. The pouches are commonly used to package a wide variety of products such as sugar, sweeteners, drink mixes, soup mixes and the like in individual or small serving sizes. Liquid products as well as dry products can be packaged in this type of pouch. A variety of web materials can be used such as paper or foil which are relatively stiff and non-extensible or oriented polypropylene or polyester which are somewhat soft and extensible. The web may be coated on at least one side with a heat sealable material such as polyethylene which is suitable for forming heat seals.

An example of a prior art pouch machine is shown in U.S. Pat. No. 3,453,799, the disclosure of which is incorporated herein by reference. The typical pouch machine includes a base supporting various components including an unwind stand for supporting a roll of pouch material. The web is unwound in a generally horizontal plane and advanced to a plow which folds the web generally in half about a longitudinal fold line. The fold line is disposed at the bottom of the web which then assumes a V-shape with front and back panels on either side of the fold in a substantially vertical plane.

The folded web is then pulled around a rotary vertical sealer which has a series of vertically extending circumferentially spaced heated lands on its periphery which are provided to form longitudinally spaced, vertically extending heat seals in the web. This sealing process forms pockets or pouches between the front and back panels of the web. The tops of the pouches remain open for filling at a filling wheel which opens the pouches and inserts the desired quantity of the product being packaged. Thereafter, the web is moved to a top sealer which seals the tops. The filled and sealed pouches are transferred to a knife which severs the pouches into what will be referred to herein as pouch units. Pouch units may be either single, individual pouches, or related groups of individual pouches, or groups of pouches that are not severed from one another but instead have perforations between them, e.g., multi-flavor packs.

The filling process naturally results in a greater portion of the product resting in the bottom portion of the pouch. Accordingly, the bottom of the pouch is often thicker than the top. This uneven thickness may create problems when many individual pouches are stacked adjacent one another or one on top of the other in a carton or other container. The pouches have a wedge-like shape and will not lay or stand in a uniform stack. If the pouches are laid flat, the stack quickly becomes out of balance, with the upper pouches tending to fall or slide off the stack. While it is possible to compensate for uneven thickness by turning half the pouches 180 degrees, extra equipment is required to do so. These handling difficulties increase the time and cost of packing pouches in cartons and make it virtually impossible to gather a complete stack outside the carton and then transfer that stack all at once into the carton. Instead, the carton must be filled gradually with pouch units as they come out of the knife.

One problem with loading pouch units seriatim into cartons is the need to alter the point where pouches are placed as the carton fills up. That is, once a conveyor or other device places a pouch in the carton, the succeeding pouch cannot follow the first pouch into the same space because if it were to do so the second pouch would collide with the first one. The second pouch has to be placed next to the first pouch. Thus, the target zone for the placement mechanism changes with every pouch. This moving target problem cannot be circumvented by inserting pouches at one end of the carton and letting them fall onto a stack built up at the opposite end of the carton. The reason is that the pouches will not reliably fall any appreciable distance without turning, tilting, twisting or canting within the carton. Instead of building up a neat stack with each pouch lying or standing flat against its neighbor, such a free falling system would lead to chaos wherein the pouches are oriented crazily in unknown fashion within the container.

There have been efforts to solve the moving target problem by moving the conveyor which places the pouches in the carton, i.e., moving the discharge point of the conveyor. This greatly complicates the conveyor's structure and fails to address the need to get a filled carton out of the way for the next, empty one.

SUMMARY OF THE INVENTION

The present invention concerns an apparatus for loading pouches, or groups of pouches into cartons in a continuous motion with as few transfer stations as possible. The direct dropping of pouch units into a carton from a conveyor coming out of the knife is one object of the present invention.

This is achieved with an indexing cartoner for packing pouch units into a carton. The cartons themselves are six-sided enclosures, typically made of corrugated cardboard or the like. Each carton has a bottom panel connected to first and second end walls which are joined by a pair of side walls. The side and end walls have foldable flaps at their upper edges. The flaps can be folded between closed positions, where they form the sixth side of the carton, and open positions wherein the walls define an open side of the carton. The walls also define a cavity within the carton.

A pouch conveyor has an entry end, a discharge end and a transport means. The entry end receives finished pouch units from the knife of a pouch-making machine. At the discharge end pouches are released from the conveyor along a discharge path and deposited into a carton. The transport means comprises a series of pins or lugs revolving on an endless chain for moving pouches from the entry end to the discharge end.

An indexing carton holder has a series of movable supports or paddles for supporting a carton adjacent the discharge end of the conveyor. The cartons are supported with the flaps restrained in their open positions so the open side of the carton faces the pouch conveyor. The discharge path of the pouch conveyor then extends through the open side and into the carton such that pouches released from the conveyor are deposited in the cavity of the carton.

The paddles orient the carton's first or leading end wall generally parallel to the plane of the pouches as they enter the carton. Furthermore, the first or leading end wall of an empty carton is transversely spaced from the discharge path a selected distance that is: 1) great enough to present an empty space or target zone to the first pouch unit entering the carton, i.e, the first pouch unit will not hit the end wall, and 2) small enough to prevent pouches from changing their orientation as they are deposited adjacent the first end wall, i.e., the pouches do not fall far enough to permit them to twist or cant in the carton. Preferably this offset of the end wall from the discharge path is approximately equal to the thickness of the pouch unit.

The cartoner further includes indexing means for moving the carton support paddles to maintain the selected offset distance between deposited pouches and the discharge path as a carton is filled with pouches. Thus, the cartoner always presents an empty cavity or target zone to succeeding pouches entering the carton. This prevents succeeding pouches from colliding with earlier ones. At the same time the empty target zone is not so large as to allow pouches to change their orientation as they are deposited adjacent the previously-deposited pouches.

When a carton is filled, the indexing means executes a so-called long move that advances the trailing end wall of the filled carton as well as the leading wall of the next empty carton past the discharge path, thereby allowing the cycle to repeat.

The carton holder is disposed at an angle of about 20 degrees from vertical. Thus, the leading wall of a carton is raised about 20 degrees from horizontal and the bottom wall is about 20 degrees from vertical. This means that pouches deposited in the carton are neither standing on edge in vertical planes nor piled one atop the other in a stack of horizontal planes. This tilting of the carton holder prevents the pouches from either falling over or sliding off the top of the stack.

DETAILED DESCRIPTION OF THE INVENTION

Figure 1:
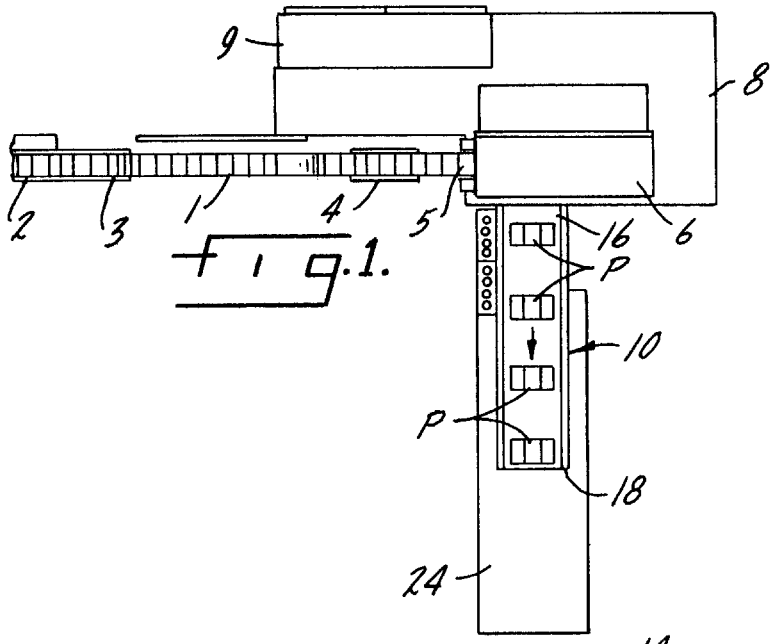
FIG. 1 is a schematic plan view of the end of a pouch making machine, showing a remote knife and the cartoner of the present invention.
Figure 2:
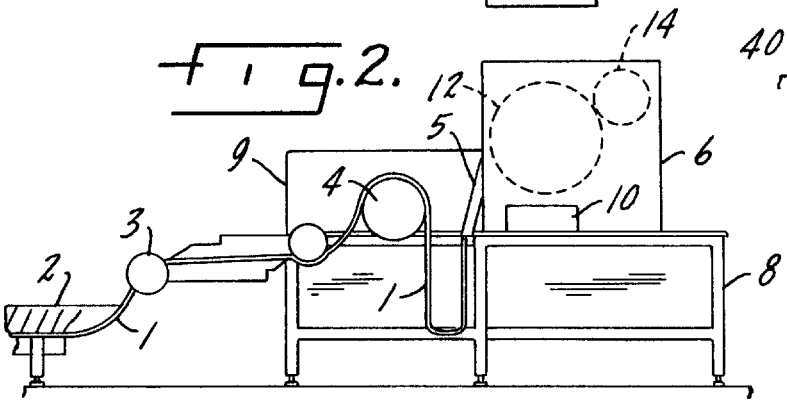
FIG. 2 is a side elevation view of the remote knife and pin conveyor.

A continuous web 1 of filled and sealed pouches is delivered to a surge or accumulating conveyor 2. From there the pouches are fed to the following units seen in FIGS. 1 and 2: a pouch conditioner 3, a squirrel cage roll 4, an infeed ramp 5 and a knife cutter unit 6 which is powered by a drive unit in cabinet 8. Electric power supply equipment is stored in cabinet 9. The pouch conditioner 2 imparts a shaking action to the web causing the product to move towards the topseal area to provide a more uniform distribution of product within the pouch. The squirrel cage roll 4 is driven from the knife drive cabinet 8 and serves to pull the web of pouches from the surge conveyor 2 and through the pouch conditioner 3.

The knife cutter unit 6 includes an infeed ramp 5 which serves to present the web 1 centrally into the knife cutter. Adjustable rails are set to the desired web width to channel the web of pouches into the cutter under a web hold down belt. A paddle rests on the web as it passes over the ramp 5 to keep the web from climbing over the rails. The paddle also functions as an empty detector by operating a proximity switch should it drop to a position nearly contacting the ramp surface. If an empty is detected the pouch or group of pouches containing the empty can be rejected out the rear of the cutter unit.

The drive cabinet 8 contains the drive unit for the squirrel cage roll 4, the knife cutter unit 6 and a pin conveyor 10. A motor/speed reducer unit (not shown) drives a single jackshaft from which the remaining drives are taken. The jackshaft drives a phase adjuster which in turn drives the major hub 12 of the knife unit. The major hub carries vacuum suction cups which grip the pouches while cooperating cutting blades on the major hub and minor hub 14 sever the pouches through their side seals. The major hub 12 carries the severed pouch units down to the pin conveyor 10. The phase adjuster changes the phasing between the cutter unit and the pin conveyor to allow fine tuning of the exact lug positions of the pin conveyor when the pouches are dropped from the major hub 12 onto the pin conveyor.

Figure 4:
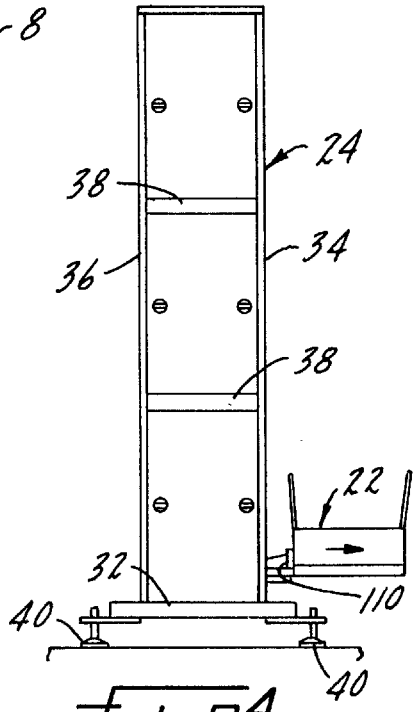
FIG. 4 is an end elevation view of the cartoner.
Figure 3:
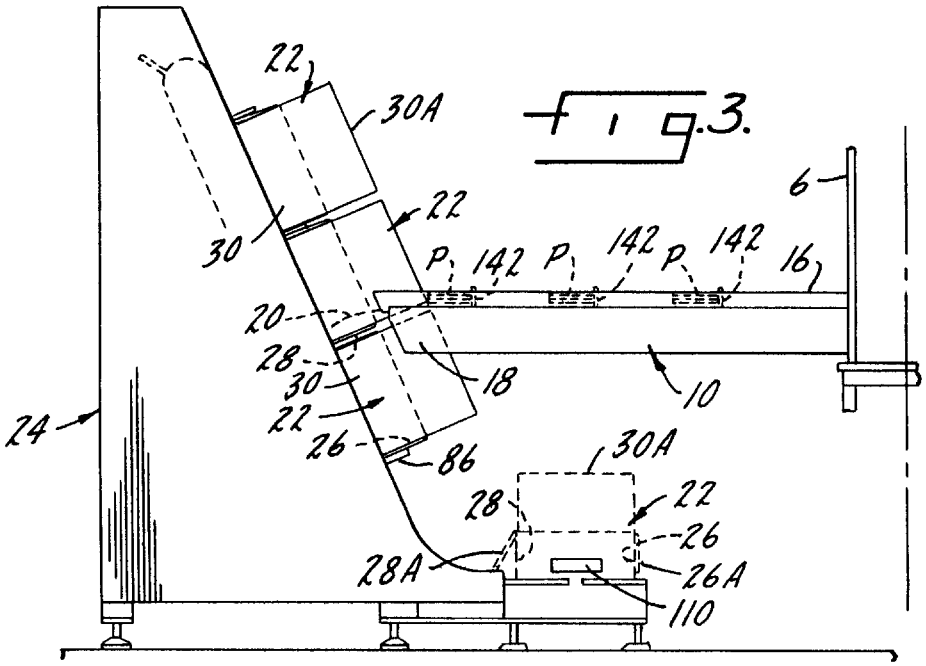
FIG. 3 is a schematic side elevation view of the cartoner of the present invention.

The cartoner of the present invention is shown in FIGS. 3 and 4. The cartoner includes the pin conveyor 10 which receives pouch units P from the knife cutter, the frame of which is shown schematically at 6. A pouch unit P preferably comprises at least three pouches, cut either singly or in groups of three which are not separated from one another. Whether the pouch units comprise an unseparated three-pack or three single pouches, one pouch is delivered to each of three lanes provided on the pin conveyor. The pouch unit shown in this embodiment is actually six pouches, with one group of three pouches stacked on top of another group of three. In other words, the knife places three pouches on the pin conveyor which remain in place until a second group of three pouches are placed on top of the first group. Then all six pouches are transferred together by the pin conveyor. The pouches are in a horizontal plane on the pin conveyor.

The pin conveyor 10 has an entry end 16 that receives the pouch units from the knife cutter unit 6. Transport means, which will be described below, move the pouch units from the entry end 16 to a discharge end 18 of the pin conveyor 10 where pouches are released from the conveyor along a discharge path 20 (FIG. 3) and deposited into a carton.

An indexing carton holder 24 supports a series of cartons 22. Cartons which have been erected and taped are placed by hand into the upper end of the holder 24. Each carton has a bottom wall (not shown) connected to first and second end walls 26, 28 which are joined by a pair of side walls, one of which is shown at 30. All four side and end walls have foldable flaps, three of which can be seen at 26A, 28A and 30A. These flaps are hinged along the upper edges of the walls. The flaps are shown in an open position which leaves an open side of the carton exposed to the pin conveyor 10. The leading and trailing minor flaps are folded down alongside the carton body prior to placement on the holder 24.

Figure 5:
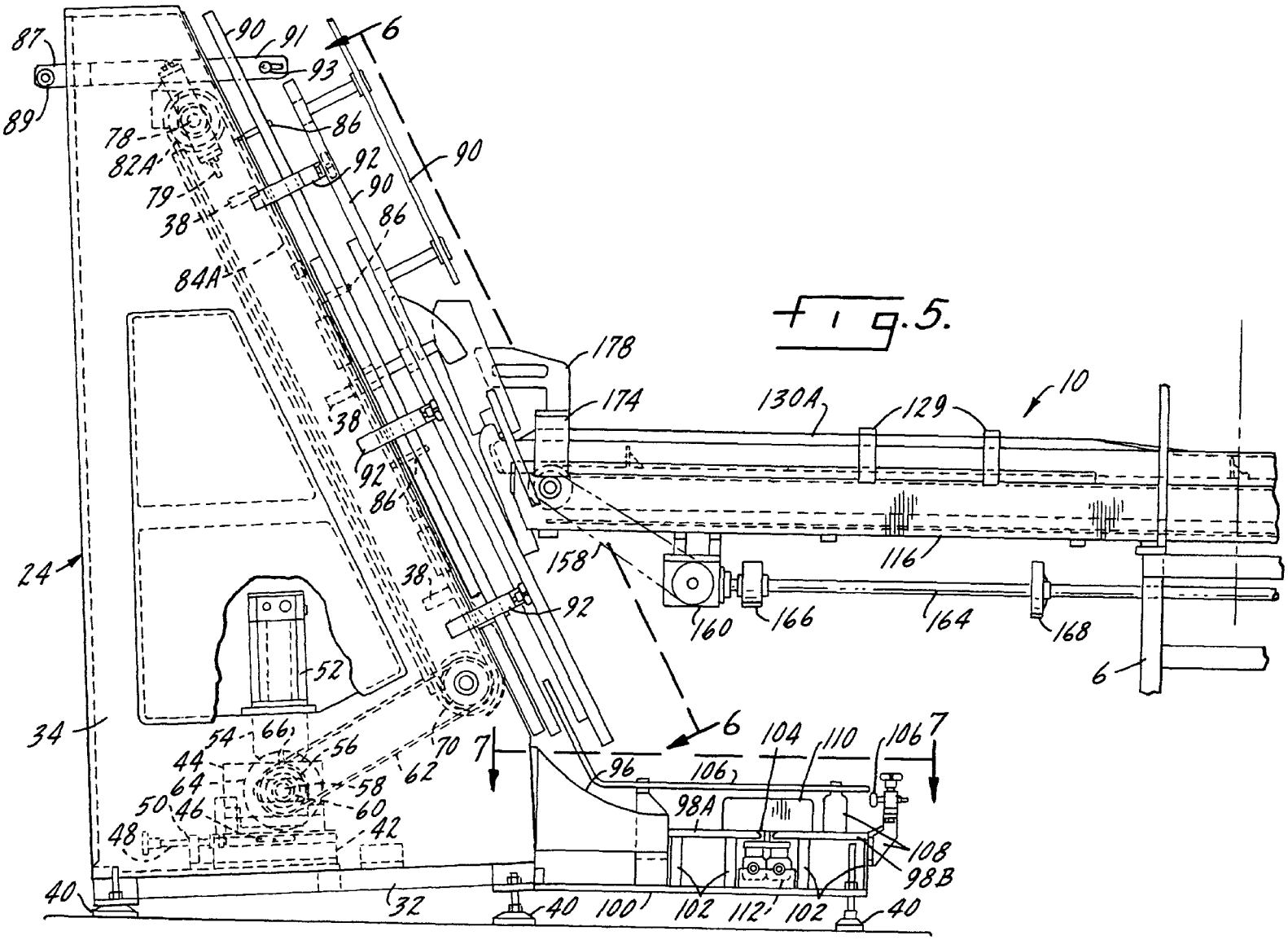
FIG. 5 is a detailed side elevation view of the cartoner.
Figure 6:
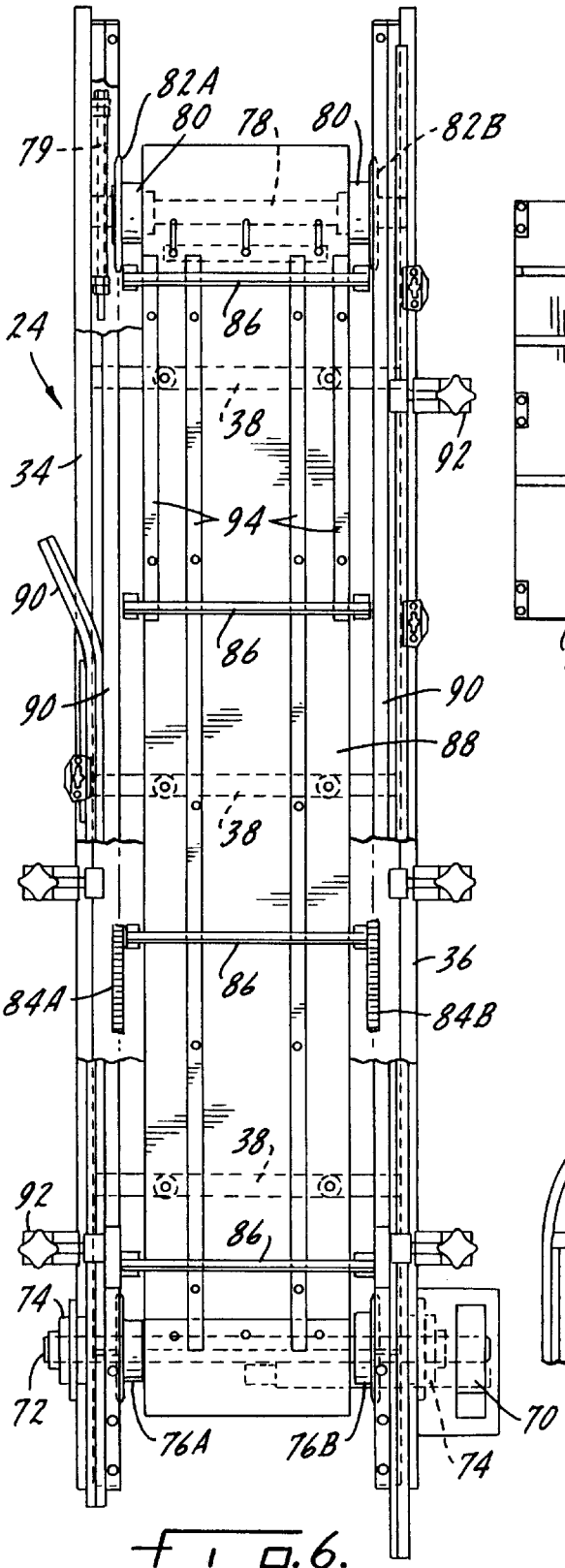
FIG. 6 a view looking in the direction of line 6—6 of FIG. 5.
Figure 7:
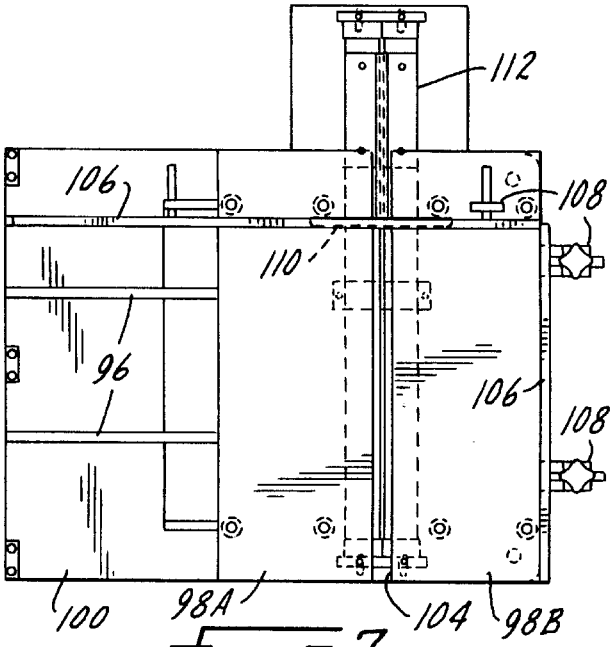
FIG. 7 is a plan view looking in the direction of line 7—7 of FIG. 5.

Details of the indexing carton holder 24 are shown in FIGS. 5–7. The frame of the holder comprises a base 32, first and second side plates 34, 36 and crossbars 38. The base rests on articulated feet 40 with vibration pads. A speed reducer base 42 is bolted to the base 32. A speed reducer 44 is mounted on the reducer base and is slidable within a slot 46. A screw 48 threaded into block 50 provides adjustment of timing belt tension by shifting the position of the speed reducer 44.

A servomotor 52 is coupled to the speed reducer through a motor adaptor 54. A drive sprocket 56 is attached to the output shaft 58 of the speed reducer by a registration collar 60. A timing belt 62 wraps around the sprocket 56. Timing adjustments can be made by loosening the collar 60 and rotating it on the output shaft 58. The output shaft 58 also carries a timing disc 64. This disc has a single slot 66. A scanner (not shown) mounted in the reducer base 42 senses the slot 66 to define a "home" or starting position for a carton. Operator controls for the machine have a "carton index" button which causes the servomotor to run continuously until the scanner aligns with the slot. With the registration collar the timing belt can be adjusted so that when the scanner aligns with the slot 66 the paddles supporting the cartons are stopped in the ideal position to begin loading a carton.

The timing belt 62 drives a sprocket 70 (FIG. 6) which is attached to a drive shaft 72. Drive shaft 72 rotates in bearings 74 carried by the lower ends of side plates 34, 36. A pair of sprockets 76A, 76B are fixed to the drive shaft 72. At the upper portion of the side plates is an idler shaft 78 whose position is adjustable by a pair of screws, one at each end of the shaft. One of the screws is visible at 79. Idler shaft 78 mounts ball bearings inside the hubs 80 of sprockets 82A, 82B which rotate on those bearings. A pair of endless chains 84A, 84B revolve around the sprockets 76A, 82A and 76B, 82B, respectively. Appropriate chain guides are attached to the side plates 34, 36 to keep the chains running smoothly.

The chains carry a series of attachment lugs which mount eight paddles 86. The paddles span the space between the chains. In the example shown a 16¼" carton is being filled so the paddles are spaced 16¼" apart. Thus, with eight paddles the chains 84 total 130" in length. The gearing of the speed reducer 44, drive sprocket 56, timing belt 62 and sprocket 70 is such that one revolution of the reducer output shaft 58 equals one complete carton, or 16¼" of paddle motion. Together the paddles 86, chains 84 and the associated drive components therefor comprise an indexing means for moving the carton support paddles to maintain the selected offset distance between the previously-deposited pouches and the discharge path as a carton is filled with pouches.

The paddles 86 are the movable elements that support the cartons. Fixed pieces also supporting the cartons include a center plate 88 and guide rails 90 which are supported on clamps 92. Wear strips 94 are affixed to the center plate. The paddles ride over the top of the wear strips, spaced slightly from them. Some of the guide rails are used to hold the flaps open so they do not interfere with the discharge path. A bracket 87 near the top of the holder frame mounts a bearing 89 in which one end of a pivot shaft 91 rotates. A transversely extending hold down rod 93 is mounted in the other end of the pivot shaft 91. The pivot shaft is counterweighted to bias it in a clockwise direction about bearing 89, as seen in FIG. 5. The hold down rod engages the trailing minor flap of the last carton to prevent it from popping up and interfering with the insertion of the next carton onto the conveyor.

When a carton is filled its paddle moves around drive sprockets 76A, 76B, releasing the carton which slides by gravity down a pair of carton slides 96 which direct the carton onto front and rear platforms 98A, 98B. The slides 96 are bolted to the lower ends of the side plates 34, 36 and are supported by a pusher mount plate 100. Spacer plates 102 on the mount plate 100 support the front and rear platforms 98A, 98B with a slot 104 between the platforms. Carton guide bars 106 are mounted on supports 108. A carton pusher bar 110 is linearly actuatable by cylinder 112 to push the filled carton transversely to an unloading position as best seen in FIG. 4.

Figure 10:
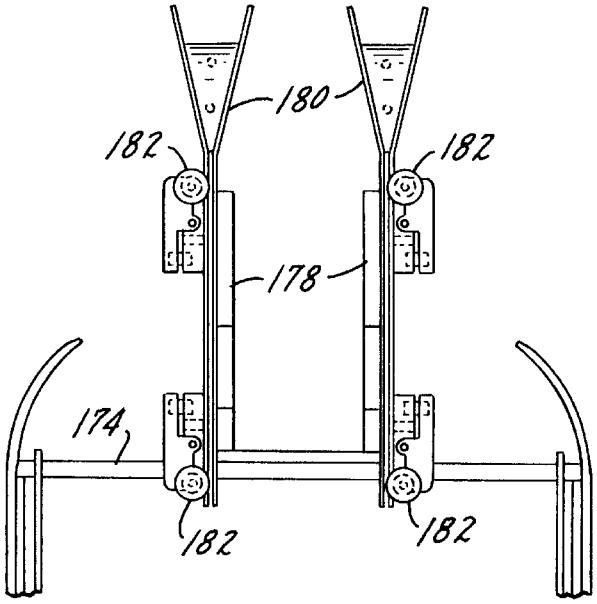
FIG. 10 is a view looking in the direction of line 10—10 of FIG. 8.
Figures 8, 9:
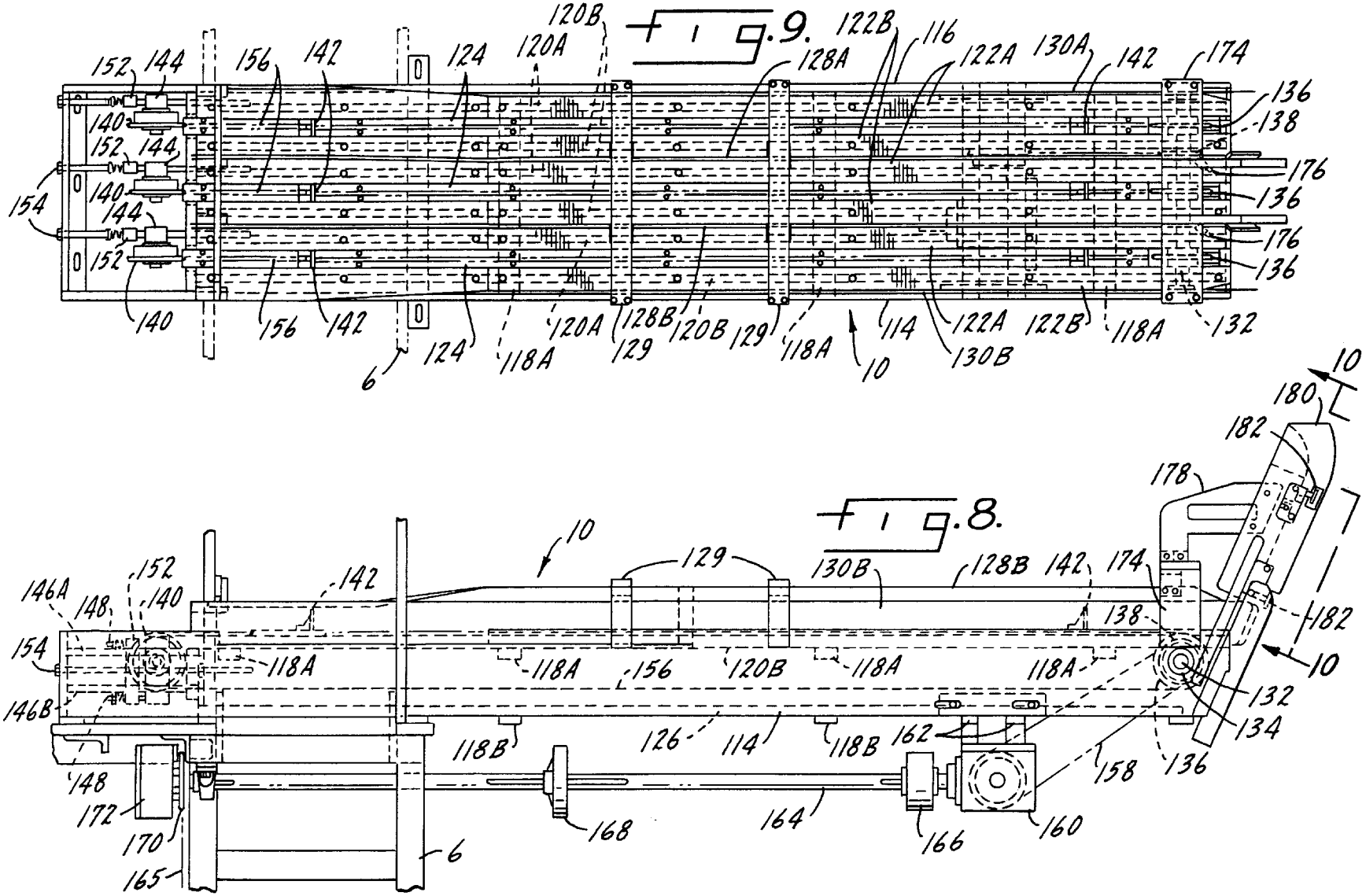
FIG. 8 is a detailed side elevation view of the pin conveyor.
FIG. 9 is a plan view of the pin conveyor.

Turning now to FIGS. 8–10, details of the pin conveyor 10 are shown. The frame of the conveyor includes first and second longitudinal side plates 114, 116 joined by upper and lower crossbars 118A, 118B. The upper crossbars support three pairs of longitudinal runner rails 120A, 120B. Each rail 120 supports a pouch runner plate 122A, 122B, which have a gap between them. In this gap rests a longitudinal upper chain guide rail 124, mounted on the crossbars 118A with a chain guide attached to this rail. A set of similar chain guide rails 126 and chain guides are mounted on the lower crossbars 118B. The pairs of pouch runners 122A, 122B may be separated by removable left and right entry guides 128A, 128B, which, together with permanent outer guides 130A, 130B define three lanes of the conveyor when individually cut pouch units are being made. When three-packs are formed the guides 128 are removed. The guides 128 are supported by transverse center guide bars 129.

A drive shaft 132 is mounted at the discharge end of the conveyor in bearings 134. Fixed to this shaft are three chain sprockets 136 and one drive sprocket 138. At the entry end of the conveyor are three idler sprockets 140, each rotatably mounted on bearings carried in blocks 144. The blocks 144 are slidably mounted on upper and lower guide rods 146A, 146B. Each block has upper and lower bolts 148 extending therefrom with a spring retained on the end of the bolt by a nut. A tensioning block 152 is associated with each block 144. Tensioning blocks 152 slide on guide rods 146 and are threaded to tensioning screws 154. Chain tension is adjusted by turning screws 154 which move tensioning blocks 152, thereby increasing or decreasing pressure on the springs which in turn adjusts the spacing between bearing blocks 144 and the drive shaft 132.

Three endless chains 156 revolve around the chain sprockets 136 and idler sprockets 140, running on the upper and lower chain guides. A series of pusher lugs 142 are attached to each chain. It will be understood that while only two sets of lugs are shown, there will be as many sets as necessary for the particular application. These lugs extend through the gaps in the pouch runner pairs 122A, 122B to engage the pouch units and push them down the lanes of the conveyor. The shaft 132 and drive sprockets 138 are driven by a belt 158 engaging drive sprocket 138 from gear box 160. The gear box is slidably mounted to a pair of transverse stringers 162 to allow belt tension adjustment. A line shaft 164 drives gear box 160 through a coupler 166. A hand wheel 168 may used to manually turn the shaft during setup and timing adjustments. A sprocket 170 on line shaft 164 receives a belt 165 for driving the line shaft from the knife drive cabinet 8. An overload clutch 172 has a plate that pops out and actuates a shutdown switch (not shown) in the event of a jam in the pin conveyor.

A bridge 174 at the discharge end of the pin conveyor mounts scanners 176, one for each lane. The scanners detect passage of a pouch unit to signal the servomotor 52 of the indexing carton holder 24 to advance the paddles.

When loading individually cut pouch units into the carton, two corrugated divider panels must be hand inserted into the cartons as they progress down the carton holder. A divider guide assembly is attached to the discharge end of the pin conveyor. Two divider guide mounts 178 support divider entry guides 180. The leading edge of a divider is placed into the fanned out end of the guides 180 and is pushed downward in the direction of carton motion, until it contacts the inside edge of the carton which will then push the divider along with it. Two spring-loaded rollers 182 within the guide assemblies will hold and guide the divider during the pouch loading period. When three packs are being loaded no dividers are needed and the divider guide assembly can be removed if desired.

The use, operation and function of the invention are as follows. The knife cutter unit 6 places pouch units P on the entry end of the pin conveyor 10. Pusher lugs 142 transport the pouch units to the discharge end of the pin conveyor, ejecting them along the discharge path 20. Each time a pouch unit passes the scanners 176, the scanners send a signal to the servomotor 52 which is programmed to make one move for each signal. For example, for a 16¼" carton to be filled with ninety pouches and a pouch unit P containing six pouches, fifteen pouch units must be placed in each carton. Accordingly, the servomotor must make fifteen moves, fourteen short moves followed by one long move to fill a carton. The long move should be about four inches for the paddle size used. The short moves should then be the distance between cartons, 16¼" less 4" divided by 14 which equals ⅞". A greater or lesser number of pouches could be put in the carton by reprogramming the number of short moves and the distance travelled by each move, the long move remaining constant at 4".

Each short move advances the cartons down the holder 24, thereby bringing a new, empty target zone of the carton into the discharge path 20, which as can be seen, remains constant. After a carton has been filled, e.g., after fourteen short moves, the servomotor executes a long move which releases the filled carton to the slides 96 and platform 98 and brings a new, empty carton to the home position to start filling with the next pouch unit off the pin conveyor 10. A scanner senses the presence of the filled container on the platform and activates the cylinder 112. The cylinder and pusher bar 110 push the carton to an unloading position. Proximity sensors are included at both ends of the cylinder to provide a pulse to return the cylinder at the end of its stroke and also to confirm that the cylinder has returned to its home position.

While a preferred form of the invention has been shown and described, it will be realized that alterations and modifications may be made thereto without departing from the scope of the following claims.

I claim:

1. A cartoner for packing pouch units into a carton having a bottom panel connected to first and second end walls joined by side walls, the walls defining an open side of the carton and a cavity therein, comprising:

a pouch conveyor having an entry end for receiving finished pouches from a pouch-making machine, a discharge end where pouches are released by gravity from the conveyor along a discharge path and deposited into a carton, and transport means movable at constant, uniform speed for moving pouches from the entry end to the discharge end;

a carton holder having movable support means for supporting a carton adjacent to but spaced from the discharge end of the conveyor such that no portion of the pouch conveyor enters the open side of the carton, with the discharge path extending through the open side and into the carton such that pouches released from the conveyor are deposited by gravity in the cavity of the carton, the support means orienting the carton's first end wall generally parallel to the plane of the pouches as they enter the carton, the first end wall of an empty carton being transversely spaced from the discharge path a selected distance sufficient to present an empty cavity to the first pouches entering the carton and to prevent said pouches from changing their orientation as they are deposited adjacent the first end wall; and indexing means for moving the carton support means to maintain the selected distance between the previously-deposited pouches and the discharge path as a carton is filled with pouches so as to present an empty cavity to succeeding pouches entering the carton and to prevent said succeeding pouches from changing their orientation as they are deposited adjacent the previously-deposited pouches.

2. The cartoner of claim 1 further characterized in that the carton holder comprises an endless carton conveyor including spaced paddles which engage the cartons.

3. The cartoner of claim 2 further characterized in that the indexing means comprises a servomotor connected to the endless conveyor.

4. The cartoner of claim 1 wherein the pouch conveyor is arranged in a horizontal plane.

5. The cartoner of claim 4 wherein the carton holder is arranged in a plane about 20 degrees from vertical.

6. A method of stacking pouch units in a carton having a bottom panel connected to first and second end walls joined by side walls, the walls defining an open side of the carton and a cavity therein, the method comprising the steps of:

placing finished pouches on the entry end of a conveyor, transporting the pouches at constant, uniform speed to a discharge end of the conveyor and releasing the finished pouches by gravity along a discharge path;

supporting a carton adjacent the discharge end of the conveyor in a manner such that the discharge path but nothing else extends through the open side and into the carton, the carton's first end wall is generally parallel to the plane of the pouches as they enter the carton, and the first end wall of an empty carton is transversely spaced from the discharge path a selected distance sufficient to present an empty cavity to the first pouches entering the carton and to prevent said pouches from changing their orientation as they are deposited adjacent the first end wall; and moving the carton to maintain the selected distance between the previously-deposited pouches and the discharge path as the carton is filled with pouches so as to present an empty cavity to succeeding pouches entering the carton and to prevent said succeeding pouches from changing their orientation as they are deposited adjacent the previously-deposited pouches.

7. A cartoner for packing pouch units into a carton having a bottom panel connected to first and second end walls joined by side walls, the walls defining an open side of the carton and a cavity therein, comprising:

a pouch conveyor having an entry end for receiving finished pouches in a horizontal plane from a pouch-making machine, a discharge end where pouches are released from the conveyor along a discharge path and deposited into a carton, and transport means including an endless chain revolving around head and tail pulleys located at the discharge and entry ends of the conveyor, respectively, the chain having pins for engaging a trailing edge of the pouches and pushing them from the entry end to the discharge end where the pouches drop off the conveyor by gravity;

a carton holder having movable support means for supporting a carton adjacent to but spaced from the discharge end of the conveyor such that no portion of the pouch conveyor enters the open side of the carton, with the discharge path extending through the open side and into the carton such that pouches released from the conveyor are deposited in the cavity of the carton, the support means orienting the carton's bottom wall normal to the discharge path and no closer than about 20 degrees to either vertical or horizontal planes.

* * * * *